United States Patent [19]

Benschop et al.

[11] Patent Number: 5,053,655

[45] Date of Patent: Oct. 1, 1991

[54] MOTOR-COMPRESSOR UNIT

[75] Inventors: Antonius A. J. Benschop, Eindhoven; Johannes C. M. Roelofs, Valkenswaard, both of Netherlands

[73] Assignee: U.S. Philips Corp., New York, N.Y.

[21] Appl. No.: 638,280

[22] Filed: Jan. 2, 1991

[30] Foreign Application Priority Data

Jan. 11, 1990 [NL] Netherlands ..... 9000078

[51] Int. Cl.[5] ..... H02K 33/00

[52] U.S. Cl. ..... 310/15; 310/37; 310/81

[58] Field of Search ..... 310/15, 21, 81, 37, 310/80; 417/417, 363; 318/114

[56] References Cited

U.S. PATENT DOCUMENTS 2,035,132 3/1936 Koenig ..... 310/21

4,810,915 3/1989 Lissenburg et al. ..... 310/37

FOREIGN PATENT DOCUMENTS 15059 of 1913 United Kingdom ..... 310/15

*Primary Examiner*—Steven L. Stephan

*Assistant Examiner*—Edward H. To

*Attorney, Agent, or Firm*—Ernestine C. Bartlett

[57] ABSTRACT

A motor-compressor unit is provided which comprises a vibration motor (1) having an armature (3) which can perform a rotationally vibrating movement about a drive shaft (4), and a compressor (10) having at least one piston (12) which can be reciprocated in a cylinder (11) by an arm (9) of the armature (3). The couping between the piston (12) and the arm (9) comprises a sleeve (15), which is slidable in a bore (16) in the piston and which is connected to the arm (9) by a ball joint (21). The oscillating movement of the arm (9) produces a helical reciprocating movement of the piston (12). This leads to an improved lubrication.

1 Claim, 1 Drawing Sheet

MOTOR-COMPRESSOR UNIT

FIELD OF THE INVENTION

The invention relates to a motor-compressor unit comprising a vibration motor having an armature which can perform a rotationally vibrating movement about a drive shaft, and a compressor having at least one piston which can be reciprocated in a cylinder by an arm of the armature, a coupling being arranged between the piston and the arm, which coupling comprises a sleeve which is pivotally connected to the arm, the piston being formed with a bore which is oriented substantially perpendicularly to the direction of movement of the piston and in which the sleeve is slidable.

BACKGROUND OF THE INVENTION

Such a motor-compressor unit is known from U.S. Pat. No. 4,810,915. FIG. 1 of said Patent shows the coupling 11 between the rotor arm 12 and the pistons 10. FIG. 3B of said Patent shows the coupling in another sectional view. This coupling is a slider mechanism, the operation of which will be explained below with reference to FIGS. 1 to 3.

Figure 1:
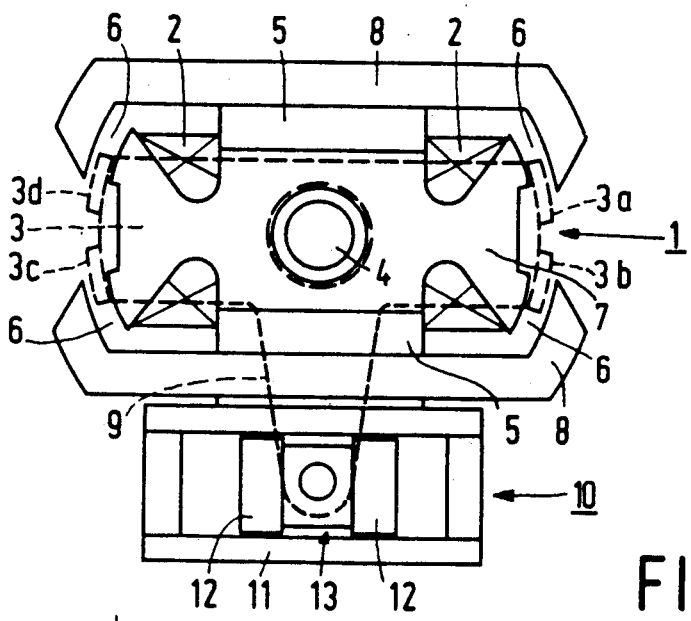
FIG. 1 diagrammatically shows a motor-compressor of the prior art U.S. Pat. No. 4,810,915.

The motor-compressor of the prior art operates as follows. An alternating current through the coils 2 of a vibration motor 1 results in a rotationally vibrating movement of the rotor 3 about the shaft 4. For each rotor section (3*a*, 3*b*, 3*c*, 3*d*) formed as a sliding element the alternating magnetic field generated by the coils is superposed on a magnetic field produced by a permanent magnet 5. As a result of this, the magnetic flux density in each rotor section alternately assumes a large and a small value. The coils are wound in such a manner relative to the direction of magnetization of the permanent magnets that at the same instant two diagonally opposed rotor sections (3*a*, 3*c*) experience a high magnetic flux density while the other two rotor sections (3*b*, 3*d*) experience a low flux density. This causes a movement of the rotor sections in air gaps 6 between the core 7 and the stator plates 8, where a high flux density exists. A change in current direction will cause the movement of the rotor 3 to be reversed, which results in a vibrating movement of the rotor.

A compressor 10 comprises a cylinder 11 in which a double piston 12 can linearly reciprocate. The piston is secured to two arms 9 at opposite sides of the rotor 3 by means of a coupling 13. This coupling a slider mechanism constructed as follows: The arms 9 are interconnected by means of a shaft 14. A sliding member 15 is rotatably supported on the shaft in the center of the shaft. In its center the double piston 12 is formed with two mutually perpendicular bores 16 and 17. These bores extend perpendicularly to the direction 18 of movement of the piston. The shaft 14 is arranged in the bore 16 and the sliding member 15 is mounted in the bore 17. In addition to a reciprocating movement for driving the piston 12 the shaft 14 with the sliding member 15 also performs an upward and downward movement relative to the piston. To make this possible the diameter of the bore 16 is such as to allow a vertical excursion 20 of the shaft 14 and the sliding member 15 is arranged to be slidable in the bore 17.

The slider mechanism described above has two locations of relative movement with comparatively small contact areas, i.e. the outer surface of the sliding member 15 against the inner wall of the bore 17 and the contact surfaces between the sliding member 15 and the shaft 14. These contact surfaces have to be finished very accurately, which makes the slider mechanism comparatively expensive. However, the wear to these contact surfaces is found to be significant, which adversely affects the life of the motor-compressor unit.

SUMMARY OF THE INVENTION

An object of the invention is to provide a coupling between the armature (rotor) and the piston for a motor-compressor unit as defined in the opening paragraph, which exhibits minimal wear and is therefore very reliable.

To this end the motor-compressor unit in accordance with the invention is characterized in that the pivotal connection between the arm and the sleeve is constituted by a ball joint, comprising a ball secured to one end of the arm, which ball is rotatably supported in the sleeve.

The principal advantage of this construction is that the piston performs a rotary movement during the reciprocating movement. Thus, the piston performs a kind of reciprocating helical movement. This produces a better pressure build-up of the oil between the piston wall and the cylinder wall, which improves the lubrication and reduces frictional losses. Moreover, the gas leakage along the piston is reduced.

Another advantage is that only one bore has to be formed in the piston and has to finished. A ball joint can be manufactured simply, is not expensive and exhibits minimal wear. The use of a ball joint enables the drive to be applied to only one side, which means that only one arm 9 with a short shaft 14 is needed. A slider mechanism also allows the use of a single-ended drive, but in that case a more robust and more accurate construction is needed.

DETAILED DESCRIPTION OF PREFERRED EMBODIMENTS

Figure 2:
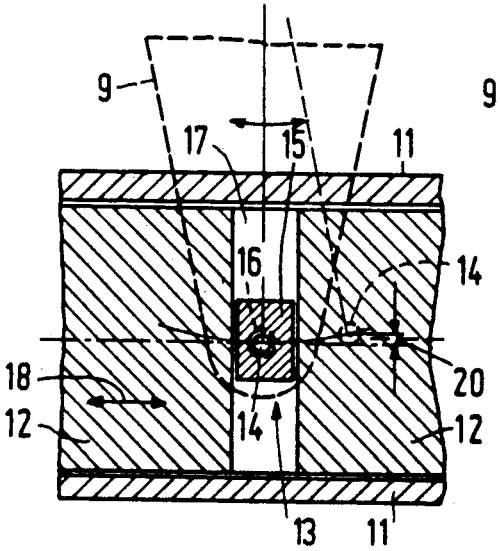
FIG. 2 is a cross-sectional view of the coupling of said prior art patent.
Figure 3:
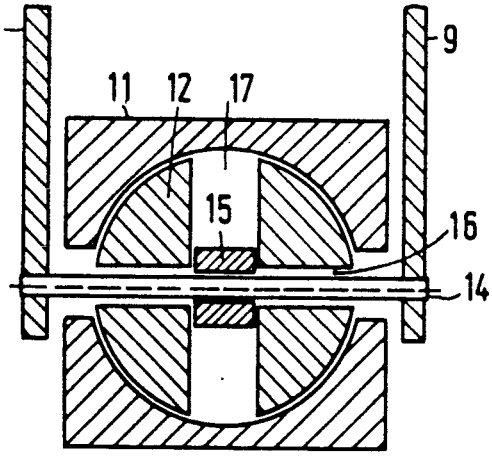
FIG. 3 is a diagrammatic cross-sectional view of the motor-compressor unit of the prior art.
Figure 4:
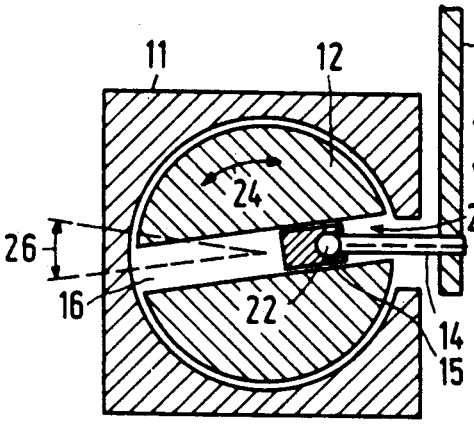
FIG. 4 is a diagrammatic cross-sectional view of a motor-compressor unit of the invention.
Figure 5:
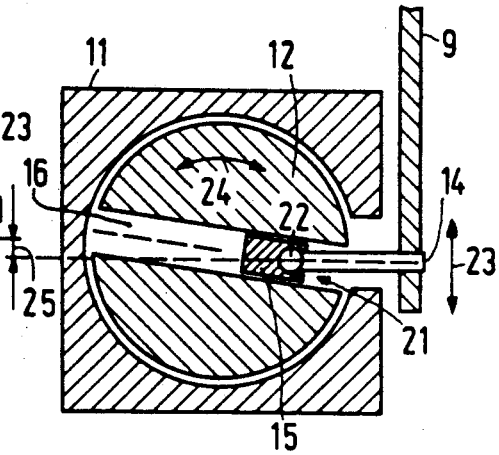
FIG. 5 is another diagrammatic cross-sectional view of a motor-compressor unit of the invention.

The invention is illustrated with reference to FIGS. 4 and 5, which are cross-sectional views of the compressor similar to those in FIG. 3. Identical parts bear the same reference numerals. The movement of the arm 9 is the same as illustrated in FIG. 2. The piston 12 has only one bore 16, in which a sleeve 15 is slidable. The shaft 14, which has one end rigidly secured to the arm 9, has its other end connected to the sleeve 15 by means of a ball joint. For this purpose the shaft 15 is provided with a ball 22, which is rotatable in a socket of the sleeve 15. The vertical up and down movement 23 of the shaft 14, produced by the reciprocating movement 23 of the arm 9, results in a rotational reciprocating movement 24 of the piston. Reference is made, for example, to FIG. 4 which shows one extreme position and to FIG. 5 which shows the other extreme position. The vertical excursion 25 of the shaft 14 produces an angular rotation 26 of the piston 12.

We claim:

1. A motor-compressor unit, comprising a vibration motor (1) having an armature (3) which can perform a rotationally vibrating movement about a drive shaft (4), and a compressor (10) having at least one piston (12) which can be reciprocated in a cylinder (11) by an arm (9) of the armature (3), a coupling (13) being arranged between the piston (12) and the arm (9), which coupling comprises a sleeve (15) which is pivotally connected to the arm (9), the piston (12) being formed with a bore (16) which is oriented substantially perpendicularly to the direction (18) of movement of the piston and in which the sleeve (15) is slidable, characterized in that the pivotal connection between the arm (9) and the sleeve (15) is constituted by a ball joint (21), comprising a ball (22) secured to one end of the arm (9), which ball (22) is rotatably supported in the sleeve (15).

* * * * *